US010589137B2

(12) United States Patent
Liu et al.

(10) Patent No.: US 10,589,137 B2
(45) Date of Patent: Mar. 17, 2020

(54) WAIST PAD BUMPER SYSTEM FOR SELF-CONTAINED BREATHING APPARATUS

(71) Applicants: Honeywell International Inc., Morris Plains, NJ (US); Bruce Liu, Shanghai (CN); Terry Zhao, Shanghai (CN); Kevin Lu, Shanghai (CN); Devin Li, Shanghai (CN)

(72) Inventors: Bruce Liu, Shanghai (CN); Terry Zhao, Shanghai (CN); Kevin Lu, Shanghai (CN); Devin Li, Shanghai (CN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 405 days.

(21) Appl. No.: 15/550,407

(22) PCT Filed: Feb. 13, 2015

(86) PCT No.: PCT/CN2015/073015

§ 371 (c)(1),
(2) Date: Aug. 11, 2017

(87) PCT Pub. No.: WO2016/127395

PCT Pub. Date: Aug. 18, 2016

(65) Prior Publication Data

US 2018/0028847 A1 Feb. 1, 2018

(51) Int. Cl.

| | |
|---|---|
| ***A62B 25/00*** | (2006.01) |
| ***A62B 9/04*** | (2006.01) |
| *A62B 7/02* | (2006.01) |

(52) U.S. Cl.

CPC ..... *A62B 25/00* (2013.01); *A62B 9/04* (2013.01); *A62B 7/02* (2013.01)

(58) Field of Classification Search

CPC .. A62B 25/00; A62B 9/04; A41B 1/00; A45F 3/10; A45F 3/04

See application file for complete search history.

(56) References Cited

U.S. PATENT DOCUMENTS

| | | | |
|---|---|---|---|
| 2003/0140392 | A1 | 7/2003 | Kling et al. |
| 2008/0035686 | A1 | 2/2008 | Gregory |

(Continued)

FOREIGN PATENT DOCUMENTS

| | | | |
|---|---|---|---|
| CN | 101001672 | A | 7/2007 |
| CN | 101179996 | A | 5/2008 |

(Continued)

OTHER PUBLICATIONS

PCT Application No. PCT/CN2015/073015, International Search Report, dated Nov. 24, 2015, 5 pages.

(Continued)

*Primary Examiner* — Brian D Nash

(74) *Attorney, Agent, or Firm* — Wick Phillips Gould & Martin, LLP

(57) ABSTRACT

Embodiments relate generally to a self-contained breathing apparatus (SCBA comprising a waist pad bumper system. The waist pad bumper system may comprise a soft rubber gasket located between the waist pad and the backplate of the SCBA, operable to compress to cushion the movement of the backplate with respect to the waist pad; a hard rubber gasket located between the waist pad and the backplate operable to compress to cushion the movement of the backplate with respect to the waist pad; one or more magnets located on the waist pad; and one or more magnets located on the backplate operable to interact with the one or more magnets located on the waist pad, wherein the magnets of the waist pad have the same polarization as the magnets of the backplate and therefore repel each other.

20 Claims, 4 Drawing Sheets

(56) References Cited

U.S. PATENT DOCUMENTS

| | | | | |
|---|---|---|---|---|
| 2008/0257928 | A1 | 10/2008 | Lowry et al. | |
| 2008/0264413 | A1* | 10/2008 | Doherty | A61M 16/021 128/202.27 |
| 2011/0179607 | A1 | 7/2011 | Colorado | |
| 2013/0240292 | A1 | 9/2013 | Steck et al. | |
| 2018/0195654 | A1* | 7/2018 | Jaeger | A62B 18/08 |
| 2018/0339177 | A1* | 11/2018 | Liu | A62B 25/00 |
| 2019/0337143 | A1* | 11/2019 | Martinez | B25H 3/022 |

FOREIGN PATENT DOCUMENTS

| | | | |
|---|---|---|---|
| CN | 101947367 | A | 1/2011 |
| CN | 102046243 | A | 5/2011 |
| CN | 107530559 | A | 1/2018 |
| EP | 3256222 | A1 | 12/2017 |
| KR | 20120085531 | A | 8/2012 |
| WO | 2016127395 | A1 | 8/2016 |

OTHER PUBLICATIONS

PCT Application No. PCT/CN2015/073015, Written Opinion of the International Searching Authority, dated Nov. 24, 2015, 3 pages.
PCT Application No. PCT/CN2015/073015, International Preliminary Report on Patentability, dated Aug. 15, 2017, 4 pages.
Europe Patent Application No. 15881557.1, Extended European Search Report, dated Sep. 29, 2018, 12 pages.

* cited by examiner

WAIST PAD BUMPER SYSTEM FOR SELF-CONTAINED BREATHING APPARATUS

CROSS-REFERENCE TO RELATED APPLICATIONS

The present application claims priority to and is the National Stage of International Application No. PCT/CN2015/073015 (entitled WAIST PAD BUMPER SYSTEM FOR SELF-CONTAINED BREATHING APPARATUS filed Feb. 13, 2015) which is incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In self-contained breathing apparatus (SCBA) systems, a user may carry a heavy cylinder or bottle, held to the user's body by a harness, shoulder straps, and/or waist straps. The cylinder may provide breathable air to the user via a facepiece, which may be a mask, hose, or other breathing equipment. SCBAs may be worn in dangerous environments where the ambient air is not safe to be breathed by a user.

SUMMARY

Aspects of the disclosure may include embodiments of a waist pad bumper system for use with a SCBA comprising a backplate operable to attach to a cylinder to hold the cylinder in place on a user's back; a waist pad operable to attach to the backplate and operable to fit around a user's waist to hold the backplate, and therefore the cylinder, in place on the user's back; a soft rubber gasket located between the waist pad and the backplate operable to compress to cushion the movement of the backplate with respect to the waist pad; a hard rubber gasket located between the waist pad and the backplate operable to compress to cushion the movement of the backplate with respect to the waist pad; one or more magnets located on the waist pad; and one or more magnets located on the backplate operable to interact with the one or more magnets located on the waist pad, wherein the magnets of the waist pad have the same polarization as the magnets of the backplate and therefore repel each other.

In some embodiments, the soft rubber gasket may cushion the movement of the backplate with respect to the waist pad in a first direction, and the hard rubber gasket may cushion the movement of the backplate with respect to the waist pad in a second direction. In some embodiments, the first direction may comprise a portion of the backplate moving toward a portion of the waist pad. In some embodiments, the second direction may comprise the backplate twisting with respect to the waist pad. In some embodiments, the system may further comprise a screw and nut operable to hold the waist pad to the backplate. In some embodiments, the one or more magnets of the waist pad may comprise at least one first magnet on an upper portion of the waist pad and at least one second magnet on a lower portion of the waist pad. In some embodiments, the one or more magnets of the backplate may comprise at least one third magnet in a location corresponding to the first magnet of the waist pad and at least one fourth magnet in a location corresponding to the second magnet of the waist pad. In some embodiments, the soft rubber gasket may comprise a shore hardness of between approximately 30 and 40. In some embodiments, the hard rubber gasket may comprise a shore harness of between approximately 50 and 65.

Additional aspects of the disclosure may include embodiments of a SCBA comprising a cylinder operable to hold breathable air; a backplate operable to attach to the cylinder to hold the cylinder in place on a user's back; a waist pad operable to attach to the backplate and operable to fit around a user's waist to hold the backplate, and therefore the cylinder, in place on the user's back; a facepiece operable to fit on the user's face to provide breathable air from the cylinder to the user; one or more shoulder pads operable to attach to the backplate and the waist pad to further stabilize the cylinder on the back of the user, wherein the waist pad further comprises a soft rubber gasket located between the waist pad and the backplate operable to compress to cushion the movement of the backplate with respect to the waist pad; a hard rubber gasket located between the waist pad and the backplate operable to compress to cushion the movement of the backplate with respect to the waist pad; and one or more magnets located on the waist pad, wherein the backplate further comprises one or more magnets located on the backplate operable to interact with the one or more magnets located on the waist pad, and wherein the magnets of the waist pad have the same polarization as the magnets of the backplate and therefore repel each other.

In some embodiments, the soft rubber gasket may cushion the movement of the backplate with respect to the waist pad in a first direction, and the hard rubber gasket may cushion the movement of the backplate with respect to the waist pad in a second direction. In some embodiments, the first direction may comprise a portion of the backplate moving toward a portion of the waist pad. In some embodiments, the second direction may comprise the backplate twisting with respect to the waist pad. In some embodiments, the SCBA may further comprise a screw and nut operable to hold the waist pad to the backplate. In some embodiments, the magnets of the waist pad and the magnets of the backplate may cushion the movement of the backplate with respect to the waist pad. In some embodiments, the soft rubber gasket may comprise a shore hardness of between approximately 30 and 40, and the hard rubber gasket may comprise a shore harness of between approximately 50 and 65.

Other aspects of the disclosure may include embodiments of a method for preventing stress on a user's back and waist when wearing a SCBA, the method comprising providing a soft rubber gasket located between a waist pad and a backplate of the SCBA; compressing the soft rubber gasket between the waist pad and the backplate to cushion the movement of the backplate with respect to the waist pad; providing a hard rubber gasket located between the waist pad and the backplate; compressing the hard rubber gasket between the waist pad and the backplate to cushion the movement of the backplate with respect to the waist pad; providing at least one magnet located on the waist pad; providing at least one magnet located on the backplate, wherein the magnet of the waist pad and the magnet of the backplate are the same polarization and therefore repel each other; and cushioning the movement of the backplate with respect to the waist pad when the magnets of the waist pad repel the magnets of the backplate.

In some embodiments, compressing the soft rubber gasket may comprise cushioning the movement of the backplate with respect to the waist pad in a first direction, and compressing the hard rubber gasket may comprise cushioning the movement of the backplate with respect to the waist pad in a second direction. In some embodiments, the first direction may comprise a portion of the backplate moving toward a portion of the waist pad, and the second direction may comprise the backplate twisting with respect to the waist pad.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include an SCBA comprising a waist pad bumper system. In some environments, when user is wearing an SCBA, the heavy cylinder attached to the back of the user may move around when the user moves, such as when running, walking, bending, kneeling, etc. The movement of the heavy cylinder may cause problems for the user, possibly injuring the back of the user. Applicants have developed a waist pad bumper system, which may be located at the point of connection between the waist pad and backplate of an SCBA, wherein the system may be operable to cushion, and otherwise hinder or affect the movement of the backplate (and cylinder) with respect to the waist pad (and the user's body).

Figure 1:
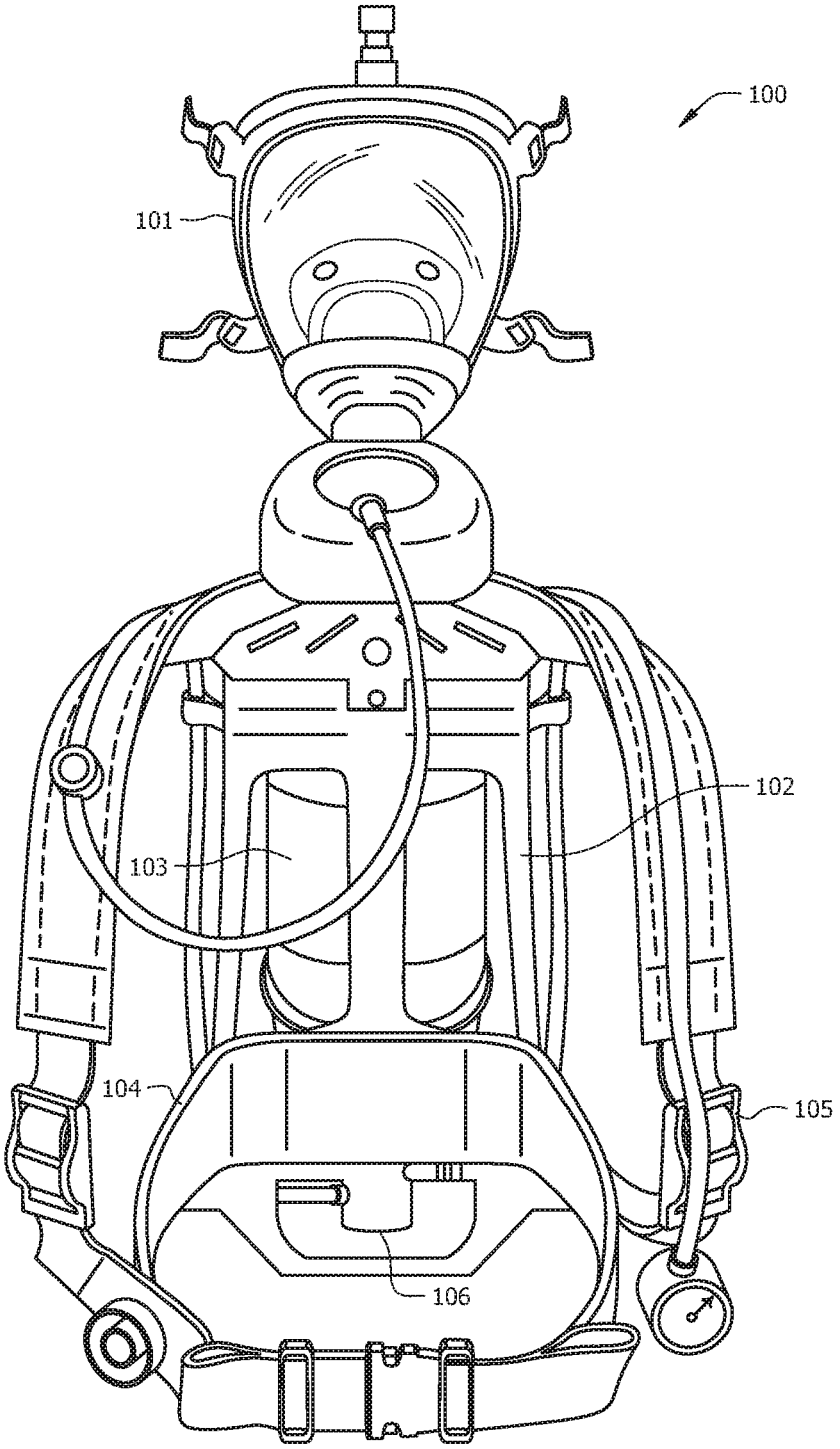
FIG. 1 illustrates a typical SCBA system.

Referring now to FIG. 1, a typical SCBA is described. The SCBA 100 may comprise a cylinder 103 operable to hold breathable air. The cylinder 103 may be attached to a backplate 102, which may be worn to hold the cylinder 103 in place on the user's back. The backplate 102 may attach to a waist pad 104 and shoulder pads (or straps) 105, which may be further operable to hold the cylinder 103 in place on the user's back. The backplate 102, waist pad 104, and should pads 105 may stabilize the cylinder 103 while the user is moving. The waist pad 104 may be fitted around the waist of the user, while the should pads 105 may fit over the shoulders and chest of a user, and the waist pad 104 and shoulder pads 105 may be attached in more than one location. The SCBA 100 may also comprise a facepiece 101 operable to fit on or over the user's face to provide breathable air from the cylinder 103 to the user. Additionally, the cylinder 103 may be attached to a reducer 106, as understood by those of skill in the art.

Figure 2:
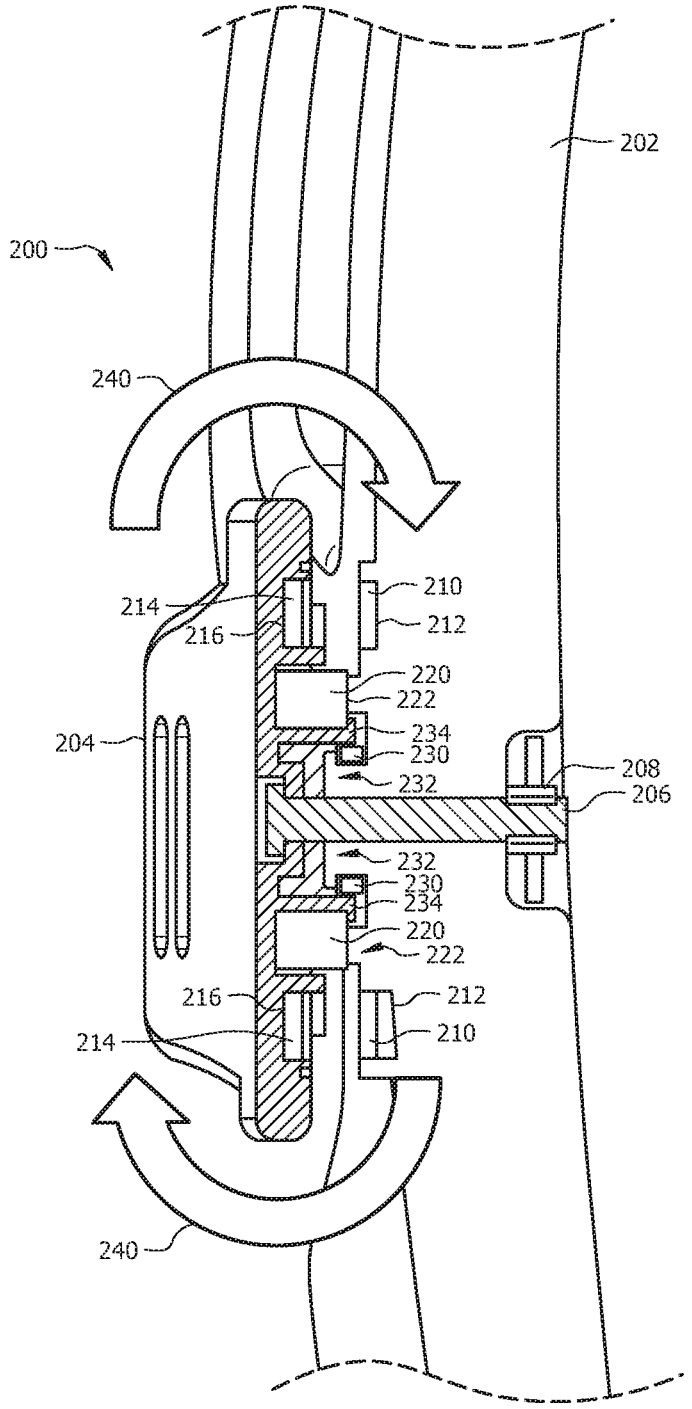
FIG. 2 illustrates a cut-away side view of an exemplary embodiment of a waist pad bumper system.

Referring to FIG. 2, a waist pad bumper system 200 is described. FIG. 2 shows a cut-away side view of the waist pad 204 and the backplate 202 of an SCBA (similar to the waist pad 104 and backplate 102 as described in FIG. 1). The waist pad 204 may be held in position with respect to the backplate 202 by a screw 206 and nut 208. In some embodiments, the waist pad 204 may be attached to the backplate 202 in a loose, movable manner. In other words, the screw 206 and nut 208 may loosely hold the waist pad 204 against the backplate 202.

In some embodiments, the waist pad bumper system 200 may comprise a soft rubber gasket 220 located between the waist pad 204 and the backplate 202, wherein the soft rubber gasket 220 may be operable to compress to cushion the movement of the backplate with respect to the waist pad. For example, the soft rubber gasket 220 may compress when the backplate 202 moves toward the waist pad 204 and may decompress when the backplate 202 moves away from the waist pad 204. This may cushion any forceful movements of the backplate 202 with respect to the waist pad 204 which may be harmful to a user's back. In some embodiments, the waist pad 204 may teeter or rock about the screw 206 with respect to the backplate 202, as shown by arrows 240, which may be beneficial to a user when bending, kneeling, or moving in another fashion. The movement of the backplate 202 with respect to the waist pad 204 indicated by the arrows 240 may allow the backplate to move to or settle into a more comfortable position with respect to the waist pad 204 when a user bends or moves. When a user returns to an upright position after bending, kneeling, etc. the backplate 202 may move with respect to the waist pad 204 back to an original upright position. This movement may be cushioned by the soft rubber gasket 220, to allow for a smooth movement and avoid forceful movements between the backplate 202 and waist pad 204.

In some embodiments, the soft rubber gasket 220 may fit around a portion 234 of the waist pad 204 and/or within a recess in the waist pad 204. The soft rubber gasket 220 may also contact a portion 222 of the backplate 202. In some embodiments, the soft rubber gasket 220 may comprise an opening operable to fit around the portion 234 of the waist pad 204, as well as the screw 206, wherein the soft rubber gasket 220 may not interfere with the attachment of the waist pad 204 to the backplate 202. In some embodiments, the soft rubber gasket 220 may comprise a shore harness of approximately 30 to 40.

In some embodiments, the waist pad bumper system 200 may comprise a hard rubber gasket 230 located between the waist pad 204 and the back plate 202, wherein the hard rubber gasket 230 may be operable to compress to cushion the movement of the backplate with respect to the waist pad. For example, the hard rubber gasket 230 may compress and/or decompress when the backplate 202 twists with respect to the waist pad 204. This may allow for movement between the backplate 202 and waist pad 204 that may be beneficial to a user when bending, kneeling, etc. The hard rubber gasket 230 may also cushion any forceful movements of the backplate 202 with respect to the waist pad 204 which may be harmful to a user's back, wherein the hard rubber gasket 230 may allow for smooth movement between the backplate 202 and waist pad 204. In some embodiments, the hard rubber gasket 230 may fit around a portion 232 of the backplate 202 and/or within a recess in the backplate 202. The hard rubber gasket 230 may also contact a portion 234 of the waist pad 204. In some embodiments, the hard rubber gasket 230 may comprise an opening operable to fit around the portion 232 of the backplate 202, as well as the screw 206, wherein the hard rubber gasket 230 may not interfere with the attachment of the waist pad 204 to the backplate 202. In some embodiments, the hard rubber gasket 230 may comprise a shore hardness of approximately 50 to 65.

In some embodiments, the waist pad bumper system 200 may comprise one or more magnets 214 located on the waist pad 204 as well as one or more magnets 210 located on the backplate 202. The magnets 210 on the backplate 202 may be operable to interact with the magnets 214 on the waist pad 204 to cushion any movement of the backplate 202 with respect to the waist pad 204. For example, the magnets 214 of the waist pad 204 and the magnets 210 of the backplate 202 may be of the same polarization and therefore may repel each other, especially when brought in close proximity to one another. This may cushion any forceful movements of the backplate 202 with respect to the waist pad 204 which may be harmful to a user's back. Additionally, the waist pad 204 may teeter or rock about the screw 206 with respect to the backplate 202, as shown by arrows 240, which may be harmful to a user's back. In some embodiments, this movement may be cushioned by the magnets 210 and 214.

In some embodiments, the magnets 214 may be located in recesses 216 of the waist pad 204. Additionally, the magnets 210 may be located in recesses 212 of the backplate 202. The magnets 214 and 210 may be positioned in such a way that each magnet 214 of the waist pad 204 corresponds to a magnet 210 of the backplate 202, as shown in FIG. 2. In the embodiment shown in FIG. 2 (and subsequent Figures), the magnets may comprise six pairs of magnets, with six on the waist pad and six on the backplate, and with three pairs above the screw and three pairs below the screw. However, any number of magnets may be used to provide the same cushioning properties.

Figure 3:
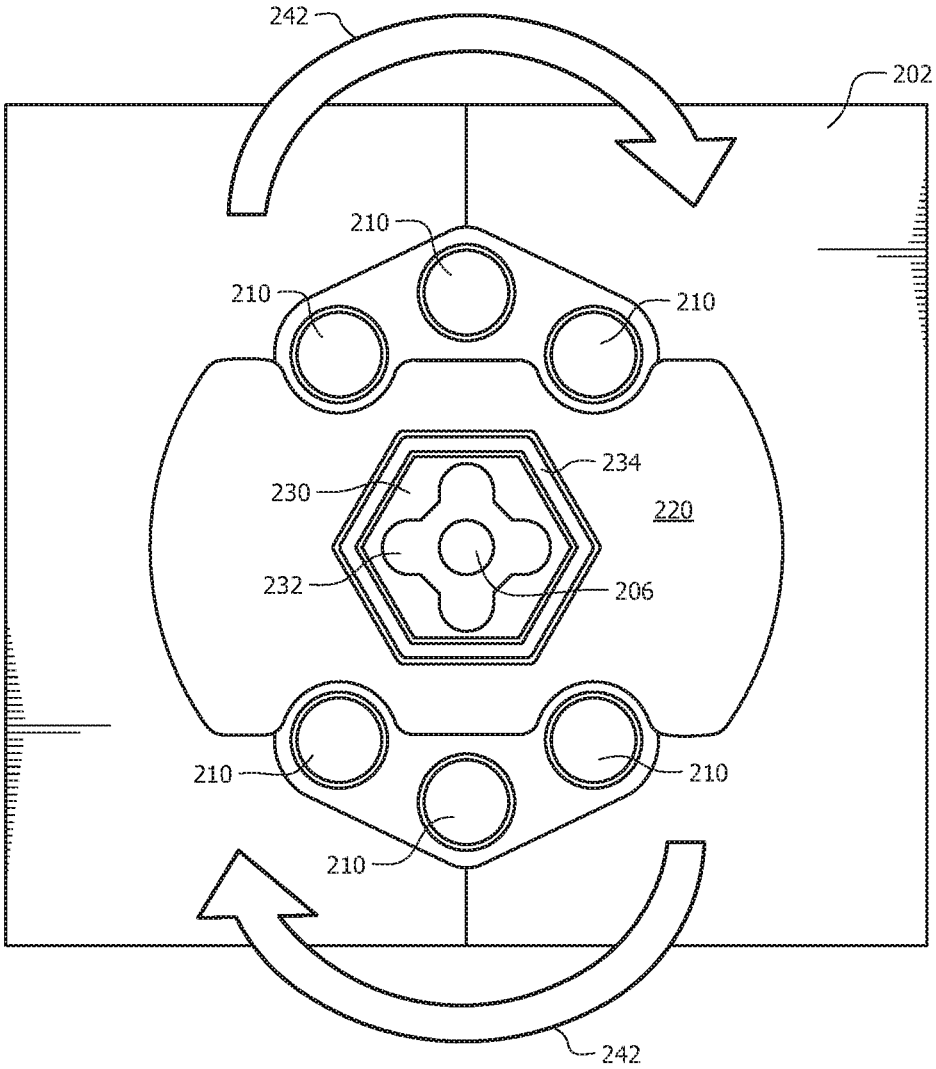
FIG. 3 illustrates another cut-away view of an exemplary embodiment of a waist pad bumper system.

Referring now to FIG. 3, another view of the waist pad bumper system 200 of FIG. 2 is shown. In FIG. 3, the waist pad 204 is cut away to show the other elements of the system 200. In FIG. 3, the soft rubber gasket 220 is shown fitting around the portion 234 of the waist pad 204 (not shown). In some embodiments, the soft rubber gasket 220 may also be shaped to avoid any interference with the magnets 210 and/or 214 (not shown). Additionally, the hard rubber gasket 230 is shown fitting around the portion 232 of the backplate 202 and within the portion 234 of the waist pad 204, wherein the hard rubber gasket 230 may interact with both the portion 232 of the backplate 202 and the portion 234 of the waist pad 204. In some embodiments, the waist pad 204 may twist about the screw 206 with respect to the backplate 202, as shown by arrows 242, which may be beneficial to a user when bending, kneeling, or moving in another fashion. The movement of the backplate 202 with respect to the waist pad 204 indicated by the arrows 240 may allow the backplate to move to or settle into a more comfortable position with respect to the waist pad 204 when a user bends or moves. When a user returns to an upright position after bending, kneeling, etc. the backplate 202 may move with respect to the waist pad 204 back to an original upright position. This movement may be cushioned by the hard rubber gasket 230, to allow for a smooth movement and avoid forceful movements between the backplate 202 and waist pad 204.

Figure 4:
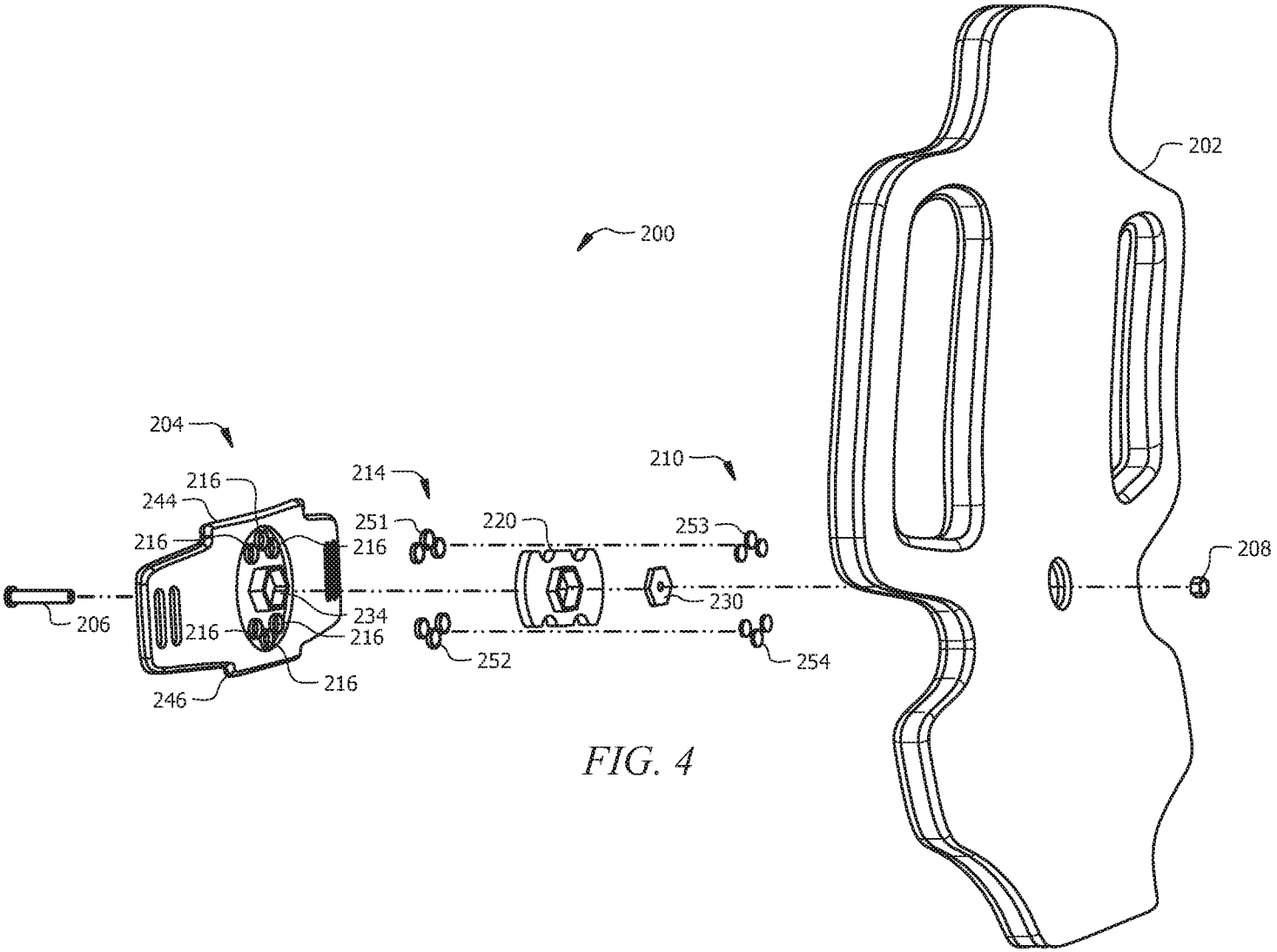
FIG. 4 illustrates an exploded view of an exemplary embodiment of a waist pad bumper system.

Referring now to FIG. 4 an exploded view of the waist pad bumper system 200 is shown. The system comprises the backplate 202, waist pad 204, screw 206 and nut 208, magnets 210 and 214, soft rubber gasket 220, and hard rubber gasket 230, as described above. These elements may be seen in greater detail in FIG. 4.

In some embodiments, the one or more magnets 214 of the waist pad 204 may comprise at least one first magnet 251 located on an upper portion 244 of the waist pad 204, and at least one second magnet 252 located on a lower portion 246 of the waist pad 204. Additionally, the one or more magnets 210 of the backplate 202 may comprise at least one third magnet 253 in a location corresponding to the first magnet 251, and at least one fourth magnet 254 in a location corresponding to the second magnet 252. The presence of magnets on both the upper and lower sides of the connection point of the waist pad 204 to the backplate 202 (at the screw 206) may allow for equal repelling and balancing of the forces between the waist pad 204 and the backplate 202.

Elements of the disclosure may also include methods of preventing stress on a user's back and waist when wearing a SCBA. The method may comprise providing a soft rubber gasket located between a waist pad and a backplate of the SCBA; compressing the soft rubber gasket between the waist pad and the backplate to cushion the movement of the backplate with respect to the waist pad; providing a hard rubber gasket located between the waist pad and the backplate; compressing the hard rubber gasket between the waist pad and the backplate to cushion the movement of the backplate with respect to the waist pad; providing at least one magnet located on the waist pad; providing at least one magnet located on the backplate, wherein the magnet of the waist pad and the magnet of the backplate are the same polarization and therefore repel each other; and cushioning the movement of the backplate with respect to the waist pad when the magnets of the waist pad repel the magnets of the backplate.

In some embodiments, compressing the soft rubber gasket may comprise cushioning the movement of the backplate with respect to the waist pad in a first direction. In some embodiments, compressing the hard rubber gasket may comprise cushioning the movement of the backplate with respect to the waist pad in a second direction. In some embodiments, the first direction may comprise a portion of the backplate moving toward a portion of the waist pad. In some embodiments, the second direction may comprise the backplate twisting with respect to the waist pad.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A waist pad bumper system for use with a self-contained breathing apparatus (SCBA) comprising:

a backplate operable to attach to a cylinder to hold the cylinder in place on a user's back;

a waist pad operable to attach to the backplate and operable to fit around a user's waist to hold the backplate, and therefore the cylinder, in place on the user's back;

a soft rubber gasket located between the waist pad and the backplate operable to compress to cushion the movement of the backplate with respect to the waist pad;

a hard rubber gasket located between the waist pad and the backplate operable to compress to cushion the movement of the backplate with respect to the waist pad;

one or more magnets located on the waist pad; and one or more magnets located on the backplate operable to interact with the one or more magnets located on the waist pad, wherein the magnets of the waist pad have the same polarization as the magnets of the backplate and therefore repel each other.

2. The system of claim 1, wherein the soft rubber gasket cushions the movement of the backplate with respect to the waist pad in a first direction, and wherein the hard rubber gasket cushions the movement of the backplate with respect to the waist pad in a second direction.

3. The system of claim 2, wherein the first direction comprises a portion of the backplate moving toward a portion of the waist pad.

4. The system of claim 2, wherein the second direction comprises the backplate twisting with respect to the waist pad.

5. The system of claim 1, further comprising a screw and nut operable to hold the waist pad to the backplate.

6. The system of claim 1, wherein the one or more magnets of the waist pad comprise at least one first magnet on an upper portion of the waist pad and at least one second magnet on a lower portion of the waist pad.

7. The system of claim 6, wherein the one or more magnets of the backplate comprise at least one third magnet in a location corresponding to the first magnet of the waist pad and at least one fourth magnet in a location corresponding to the second magnet of the waist pad.

8. The system of claim 1, wherein the soft rubber gasket comprises a shore hardness of between approximately 30 and 40.

9. The system of claim 1, wherein the hard rubber gasket comprises a shore harness of between approximately 50 and 65.

10. A self-contained breathing apparatus (SCBA) comprising:

a cylinder operable to hold breathable air;

a backplate operable to attach to the cylinder to hold the cylinder in place on a user's back;

a waist pad operable to attach to the backplate and operable to fit around a user's waist to hold the backplate, and therefore the cylinder, in place on the user's back;

a facepiece operable to fit on the user's face to provide breathable air from the cylinder to the user;

one or more shoulder pads operable to attach to the backplate and the waist pad to further stabilize the cylinder on the back of the user, wherein:

the waist pad further comprises:

a soft rubber gasket located between the waist pad and the backplate operable to compress to cushion the movement of the backplate with respect to the waist pad;

a hard rubber gasket located between the waist pad and the backplate operable to compress to cushion the movement of the backplate with respect to the waist pad; and one or more magnets located on the waist pad;

the backplate further comprises one or more magnets located on the backplate operable to interact with the one or more magnets located on the waist pad; and the magnets of the waist pad have the same polarization as the magnets of the backplate and therefore repel each other.

11. The SCBA of claim 10, wherein the soft rubber gasket cushions the movement of the backplate with respect to the waist pad in a first direction, and wherein the hard rubber gasket cushions the movement of the backplate with respect to the waist pad in a second direction.

12. The SCBA of claim 11, wherein the first direction comprises a portion of the backplate moving toward a portion of the waist pad, and wherein the second direction comprises the backplate twisting with respect to the waist pad.

13. The SCBA of claim 10, further comprising a screw and nut operable to hold the waist pad to the backplate.

14. The SCBA of claim 10, wherein the magnets of the waist pad and the magnets of the backplate cushion the movement of the backplate with respect to the waist pad.

15. The SCBA of claim 10, wherein the soft rubber gasket comprises a shore hardness of between approximately 30 and 40, and wherein the hard rubber gasket comprises a shore harness of between approximately 50 and 65.

16. A method for preventing stress on a user's back and waist when wearing a self-contained breathing apparatus (SCBA), the method comprising:

providing a soft rubber gasket located between a waist pad and a backplate of the SCBA;

compressing the soft rubber gasket between the waist pad and the backplate to cushion the movement of the backplate with respect to the waist pad;

providing a hard rubber gasket located between the waist pad and the backplate;

compressing the hard rubber gasket between the waist pad and the backplate to cushion the movement of the backplate with respect to the waist pad;

providing at least one magnet located on the waist pad;

providing at least one magnet located on the backplate, wherein the magnet of the waist pad and the magnet of the backplate are the same polarization and therefore repel each other; and cushioning the movement of the backplate with respect to the waist pad when the magnets of the waist pad repel the magnets of the backplate.

17. The method of claim 16, wherein compressing the soft rubber gasket may comprise cushioning the movement of the backplate with respect to the waist pad in a first direction.

18. The method of claim 17, wherein the first direction may comprise a portion of the backplate moving toward a portion of the waist pad.

19. The method of claim 16, wherein compressing the hard rubber gasket may comprise cushioning the movement of the backplate with respect to the waist pad in a second direction.

20. The method of claim 19, wherein the second direction may comprise the backplate twisting with respect to the waist pad.

* * * * *